US005920992A

United States Patent [19]

Watermolen et al.

[11] Patent Number: 5,920,992

[45] Date of Patent: Jul. 13, 1999

[54] TWO HANDLE PIZZA CUTTER

[76] Inventors: Joshua J. Watermolen; Steve J. Peters, both of 749 Morning Glory La., De Pere, Wis. 54115

[21] Appl. No.: 08/979,826

[22] Filed: Nov. 24, 1997

[51] Int. Cl.[6] ..... B26B 3/00

[52] U.S. Cl. ..... 30/315; 30/114; 30/312; 30/356

[58] Field of Search ..... 30/315, 312, 114, 30/356

[56] References Cited

U.S. PATENT DOCUMENTS

| | | | |
|---|---|---|---|
| 116,136 | 6/1871 | Aguayo . | |
| D. 144,225 | 3/1946 | Teague . | |
| D. 152,600 | 2/1949 | Danielson . | |
| D. 330,665 | 11/1992 | Neuendorf . | |
| 488,289 | 12/1892 | Schofield | 30/315 |
| 749,357 | 1/1904 | Breitstein | 30/312 |
| 986,166 | 3/1911 | Haas | 30/312 |
| 1,533,305 | 4/1925 | Burton | 30/315 |
| 4,574,479 | 3/1986 | Gramann . | |
| 4,625,404 | 12/1986 | Valente et al. | 30/114 |
| 4,924,575 | 5/1990 | James . | |
| 4,959,905 | 10/1990 | Ghislain . | |

FOREIGN PATENT DOCUMENTS

| | | | |
|---|---|---|---|
| 380949 | 9/1923 | Germany | 30/312 |
| 281932 | 1/1931 | Italy | 30/312 |
| 351122 | 8/1937 | Italy | 30/312 |
| 96265 | 7/1939 | Sweden . | |

*Primary Examiner*—M. Rachuba
*Assistant Examiner*—Sean Pryor
*Attorney, Agent, or Firm*—Richard C. Litman

[57] ABSTRACT

A pizza cutter with a dull convex cutting blade and a handle having two upwardly tilting ends. The non-cutting edge of the blade is fixed into a downwardly extending portion of the handle member. One end of the handle member includes a substantially oval opening for accommodating the fingers and the opposite end of the handle member has a straight handle. Each handle has a plurality of finger receiving indentations, adapted to receive the index, middle, ring, little finger, and/or thumb of a user. In use, the hands assume their respective positions at the opposite ends of the handle. The hands are alternately moved in a rocking motion while applying a downward pressure on each handle, to cut a pizza. By requiring the placement of each hand on a specific portion of the handle member, a user's fingers will not be inadvertently placed under the blade and injured. In addition, the hands are not placed directly above the pizza, so that if a hand slips from the cutter it is less likely to make contact with the hot pizza.

2 Claims, 3 Drawing Sheets

TWO HANDLE PIZZA CUTTER

BACKGROUND OF THE INVENTION

1. Field of the Invention

The present invention relates to knives, and more specifically to a two handle pizza cutting knife.

2. Description of the Related Art

Devices have been proposed by which a pizza may be cut or sliced. Such devices are well known in the art as evidenced by U.S. Patents to Hugh D. Gramann, U.S. Pat. No. 4,574,479; Jeffrey P. James, U.S. Pat. No. 4,924,575; and Michael Ghislain, U.S. Pat. No. 4,959,905. Each of these Patents discloses a pizza cutter having a convex blade adapted for slicing pizza using a rocking motion. Cutting tools having convex shapes have also been the subject of U.S. Design patents including those to James Teague, U.S. Pat. No. 144,225; Paul F. Danielson, U.S. Pat. No. 152,600; and John M. Neuendorf, U.S. Pat. No. 330,665. In addition, U.S. Pat. No. 116,136, to Jose M. Aguayo shows an improvement in tobacco-cutters having a slightly convex cutting blade. Swedish Patent Number 96,265, also shows a knife with a convex cutting blade.

However, none of the aforementioned patents disclose a pizza cutter having a convex blade and a handle member having two distinct handles each having finger receiving indentations, wherein one handle extends beyond the front edge of the blade and the other extends beyond the rear edge of the blade.

None of the above inventions and patents, taken either singularly or in combination, is seen to describe the instant invention as claimed. Thus a two handle pizza cutter solving the aforementioned problems is desired.

SUMMARY OF THE INVENTION

Safety is of great concern when cutting pizza. The large size of a pizza requires either a roller with handle type cutter or a large blade type cutter. Roller type cutters have numerous disadvantages including difficulty with cleaning, lack of protection from the sharp cutting edge of the roller blade, and a propensity for a user's hand coming into contact with dangerously hot pizza. Previous attempts at convex blade pizza cutters have addressed the concerns with respect to ease of cleaning, but lack improvement in proper handing of these cutters, thus leaving the possibility of injury.

The demand for quick solutions to meal requirements has greatly increased orders for home delivery items, pizza being among the most popular. The speed at which these items are prepared requires high temperatures and rapid hand work. At the time of cutting, being rushed and taking short-cuts can lead to injury. For example, when using a roller type cutter, one hand moves the cutter forward and back across the surface of a pizza while the other turns the pizza between cuts. A misplaced hand can easily be cut during this process. The greater risk with large convex blade pizza cutters is making contact with the hot pizza itself. With large convex blade cutters, a users hands are placed directly above the pizza. If, while exerting considerable downward pressure to cut a pizza, a users hand slips from the cutter, the hand will make contact with the hot pizza, possibly causing burns and certainly damaging the pizza. A pizza cutter which necessarily keeps both of a users hands well beyond the cutting blade as well as distant from the hot pizza, and providing a safe pizza cutter which is easily cleaned is thus desirable.

The pizza cutter of the instant invention is made up of a dull convex cutting blade and a handle member having two upwardly tilting ends with handles. When in use, the two handle composition increases the efficiency by which pizza may be cut, while reducing the risk of injury, especially to the fingers, during the cutting activity. The non-cutting edge of the blade is fixed into a downwardly extending portion of the handle member. One end of the handle member includes a substantially oval opening for accommodating the fingers and the opposite end of the handle member has a straight handle. Each handle has a plurality of finger receiving indentations formed therein. The finger receiving indentations are adapted to receive the index, middle, ring, little finger, and/or thumb of a person as he or she grips the handle, so that the pizza cutter may be gripped firmly and securely with little effort.

In use, the hands assume their respective positions at the opposite ends of the handle. The hands are alternately moved in a rocking motion while applying a downward pressure on each handle in turn, thereby cutting the pizza in an efficient and expeditious manner. By requiring the placement of each hand on a specific portion of the handle member, the pizza cutter prevents a users fingers from being inadvertently placed under the blade and injured. In addition, the hands are not placed directly above the pizza, so that if a user's hand slips from the cutter it is less likely to make contact with the hot pizza, thereby reducing the risk of injury to the user or damage to the pizza.

Accordingly, it is a principal object of the invention to provide a pizza cutter with a dull convex cutting blade that includes a handle member having two upwardly tilting ends with handles.

It is another object of the invention to provide a pizza cutter having a two handle composition that increases the efficiency by which pizza may be cut while reducing the risk of injury, especially to the fingers, during the cutting activity.

It is a further object of the invention to provide a pizza cutting device with handles that each have a plurality of finger receiving indentations formed therein which are adapted to receive the index, middle, ring, little finger, and/or thumb of a person as he or she grips the handle, so that the pizza cutter may be gripped firmly and securely with little effort.

Still another object of the invention is to provide a pizza cutter that requires the hands to be not placed directly the pizza so that if a hand slips from the cutter it is less likely to make contact with the hot pizza, thereby reducing the risk of injury to the users hands or damage to the pizza.

It is an object of the invention to provide improved elements and arrangements thereof in a two handle pizza cutter for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 2:
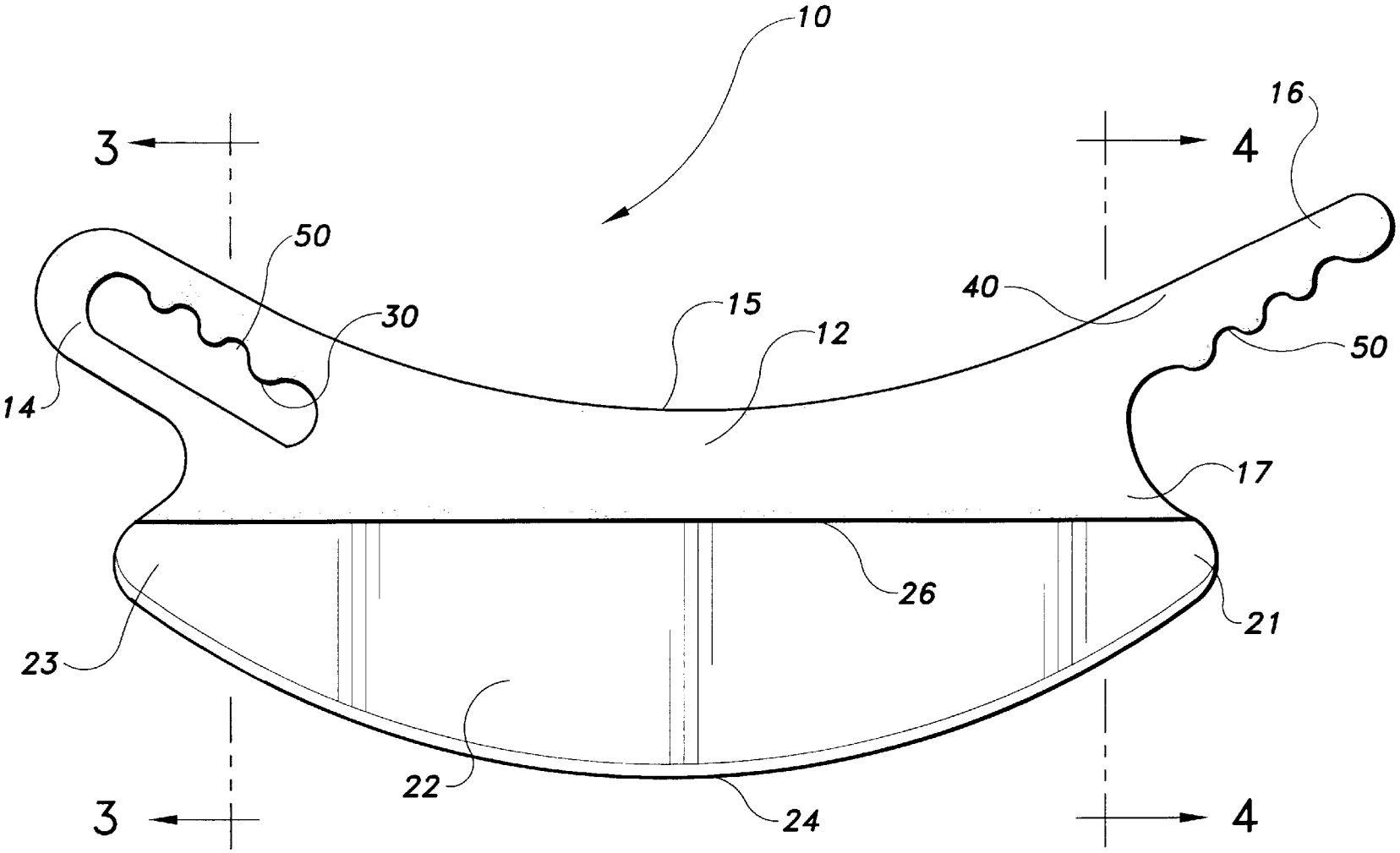
FIG. 2 is a side view of the pizza cutter.

Referring to the figures by numerals of reference, and first to FIG. 2, a two handle pizza cutter generally designated by the reference numeral 10 will be described. The two handle pizza cutter has a plastic handle member 12 and a stainless steel, dull convex cutting blade 22. The cutting blade 22 has a back end 23 and a front end 21, a convex cutting edge 24, and a straight non-cutting edge 26. The handle member 12 has a first hand receiving portion 14, a second hand receiving portion 16, a concave top portion 15, and a downwardly extending bottom portion 17. The non-cutting edge 26 of the blade 22 is fixed into the bottom portion 17 of the handle member 12 by a plurality of stainless steel rivets (not shown). Alternatively, the two handle pizza cutter 10 may be of one-piece construction.

The first hand receiving portion 14 of the handle member 12 extends beyond the back end 23 of the cutting blade 22 and includes a substantially oval opening 30 for accommodating the fingers, having a plurality of finger receiving indentations 50 formed therein adapted to receive the index, middle, ring, little finger, and/or thumb of a person. The second hand receiving portion 16 extends beyond the front end 21 of the cutting blade 22 and includes a straight handle 40, having a plurality of finger receiving indentations 50 formed thereon adapted to receive the index, middle, ring, little finger, and/or thumb of a person.

Figure 1:
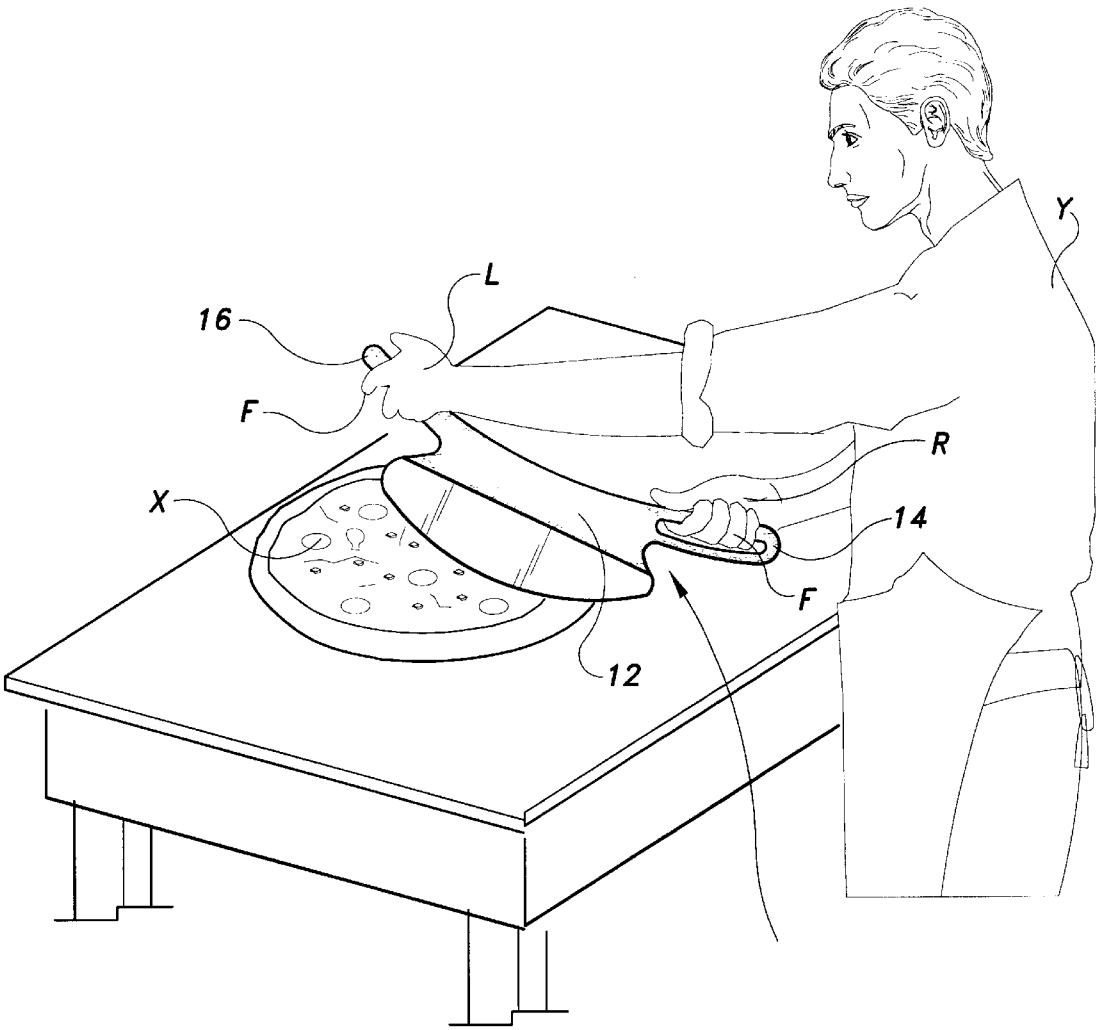
FIG. 1 is an environmental perspective view of a pizza cutter according to the present invention.

Referring to FIG. 1, to use the pizza cutter 10, the left hand L and the right hand R of the user Y assume their respective positions at the opposite ends 16, 14 of the handle 12, respectively. The hands are alternately moved in a rocking motion while applying a downward pressure on each handle 30, 40 in turn, thereby cutting the pizza X in an efficient and expeditious manner. By requiring the placement of each hand L and R on a specific portion of the handle member 12, the pizza cutter 10 prevents a users fingers F from being inadvertently placed under the blade 22 and injured. In addition, the hands L, R are not placed directly above the pizza X so that if a hand slips, from the cutter 10, it is less likely to make contact with the hot pizza X, thereby reducing the risk of injury to the user or damage to the pizza X.

Figure 3:
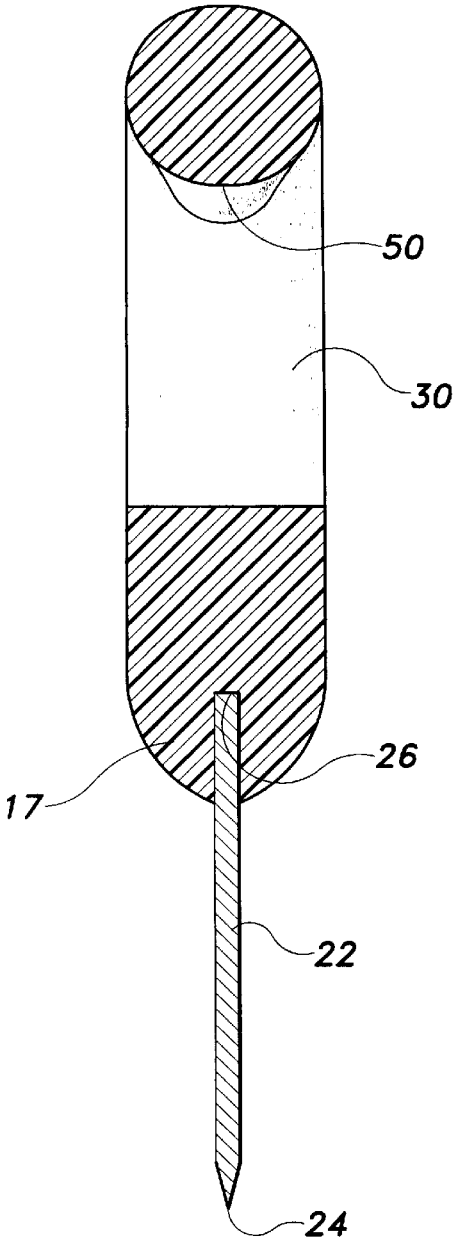
FIG. 3 is a cross-sectional view of the pizza cutter taken along lines 3—3 of FIG. 2.
Figure 4:
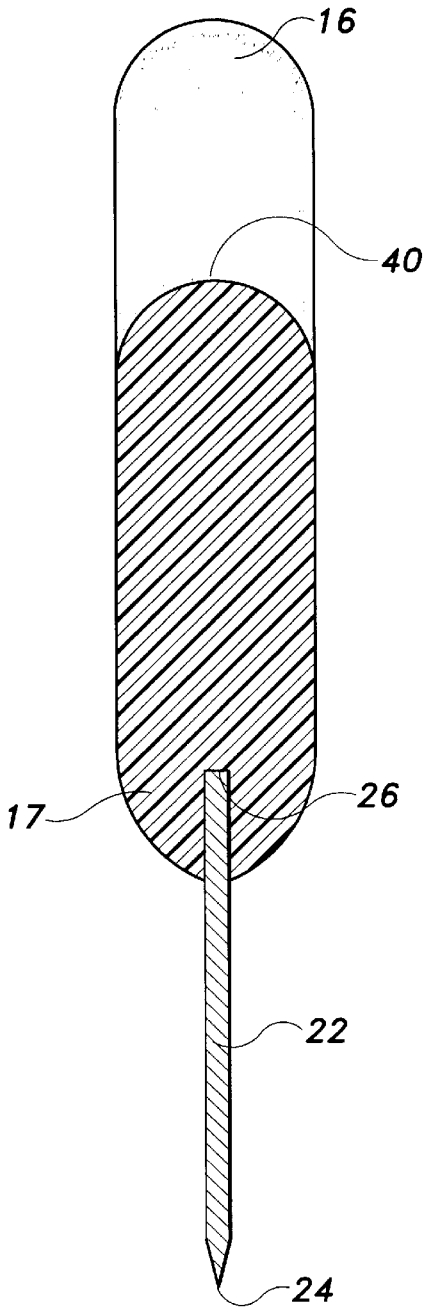
FIG. 4 is a cross-sectional view of the pizza cutter taken along lines 4—4 of FIG. 3.

Referring to FIG. 3, the pizza cutter 10 is seen in cross section showing the non-cutting edge 26 of the blade 22 fit into the bottom portion 17 of the handle member 12 and the finger indentions 50 within the oval opening 30. The upward tilt of the front end 16 of the handle member 12 is clearly shown by FIG. 4.

It is to be understood that the present invention is not limited to the embodiments described above, but encompasses any and all embodiments within the scope of the following claims.

We claim:

1. A two handle pizza cutter consisting of:

a handle member having opposed ends, one end having a first hand receiving portion, and the other end having a second hand receiving portion, a concave top portion extending between the opposed ends, and a bottom portion; and a stainless steel cutting blade having a back end, a front end, a substantially dull convex cutting edge, and a substantially straight non-cutting edge, said non-cutting edge of said blade being fixedly secured to said bottom portion of said handle member;

said first hand receiving portion being dimensioned and configured to extend substantially beyond said back end of said cutting blade;

said second hand receiving portion being dimensioned and configured to extend substantially beyond said front end of said cutting blade;

said first hand receiving portion defining a substantially oval opening therethrough for accommodating the fingers, and further having a plurality of finger receiving indentations formed therein;

said second hand receiving portion configured substantially as a straight handle, and further having a plurality of finger receiving indentations formed thereon.

2. The two handle pizza cutter as defined in claim 1, wherein said handle member is fabricated from a plastics material.

* * * * *